US007603046B2

(12) United States Patent
Hirayama

(10) Patent No.: US 7,603,046 B2
(45) Date of Patent: Oct. 13, 2009

(54) IMAGE FORMING APPARATUS INCLUDING TONER SUPPLY CONTROLLING UNIT

(75) Inventor: Yushi Hirayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 447 days.

(21) Appl. No.: 11/464,046

(22) Filed: Aug. 11, 2006

(65) Prior Publication Data

US 2007/0053703 A1 Mar. 8, 2007

(30) Foreign Application Priority Data

Sep. 5, 2005 (JP) ..... 2005-256595

(51) Int. Cl.
*G03G 15/08* (2006.01)

(52) U.S. Cl. ..... 399/27; 399/30; 399/43; 399/44

(58) Field of Classification Search ..... 399/27, 399/30, 44, 43

See application file for complete search history.

(56) References Cited

U.S. PATENT DOCUMENTS

| | | | |
|---|---|---|---|
| 2005/0207766 | A1 | 9/2005 | Hasegawa et al. |
| 2006/0002724 | A1 | 1/2006 | Fujimori et al. |

FOREIGN PATENT DOCUMENTS

| | | |
|---|---|---|
| JP | 2002-14588 | 1/2002 |
| JP | 2002-207357 | 7/2002 |
| JP | 2002-214891 | 7/2002 |
| JP | 2003-255696 | 9/2003 |
| JP | 2003-280355 | 10/2003 |
| JP | 2003-295601 | 10/2003 |
| JP | 2004-53744 | 2/2004 |

OTHER PUBLICATIONS

U.S. Appl. No. 11/952,553, filed Dec. 7, 2007, Tomita, et al.
U.S. Appl. No. 11/748,090, filed May 4, 2007, Takeuchi, et al.
U.S. Appl. No. 11/761,731, filed Jun. 12, 2007, Tanaka, et al.

*Primary Examiner*—William J Royer
(74) *Attorney, Agent, or Firm*—Oblon, Spivak, McClelland, Maier & Neustadt, L.L.P.

(57) ABSTRACT

An image forming apparatus includes a developer container that holds a two-component developer, a toner concentration detector that detects toner concentration in the developer, a toner supplying unit configured to supply new toner to a developing unit, a toner supply controlling unit that compares an output of the toner concentration detector and a toner concentration reference value Vtref to control the toner supplying unit. The image forming apparatus detects an output of the toner concentration sensor with respect to a plurality of linear velocities, and calculates linear velocity shift amounts $\Delta Vt1=(Vt1-Vt0)$ and $\Delta Vt2=(Vt2-Vt0)$ to be reflected in a toner supply control parameter.

9 Claims, 12 Drawing Sheets

IMAGE FORMING APPARATUS INCLUDING TONER SUPPLY CONTROLLING UNIT

CROSS-REFERENCE TO RELATED APPLICATIONS

The present document incorporates by reference the entire contents of Japanese priority document, 2005-256595 filed in Japan on Sep. 5, 2005.

BACKGROUND OF THE INVENTION

1. Field of the Invention

The present invention relates to an image forming apparatus configured as a multifunction product.

2. Description of the Related Art

Recently, multifunction image forming apparatuses are required to provide high quality images with high durability and high stability. That is, such an image forming apparatus needs to provide an image with little change in quality due to environmental changes, which is constantly stable over time. A two-component developing system is well known in which a two-component developer (hereinafter, "developer") that contains a non-magnetic toner and a magnetic carrier is held on a developer carrier (hereinafter, "developing sleeve"), a magnetic brush is formed by magnetic poles included therein, and a developing bias is applied to the developing sleeve at a position facing a latent image carrier to develop a latent image. The two-component developing system is widely used because of its easiness of colorization. In this system, the two-component developer is conveyed to a developing region with the rotation of the developing sleeve. While the developer is conveyed to the developing region, magnetic carriers in the developer are concentrated together with toners along magnetic lines of a developing pole to form the magnetic brush.

In the two-component developing system, differently from a one-component developing system, it is preferential to precisely control a weight ratio of toners to carriers (toner concentration) to thereby improve stability. For example, when the toner concentration is excessively high, background stain occurs on an image or resolving power decreases at detailed parts. When the toner concentration is low, the concentration of a solid image portion lowers or carrier adhesion occurs. Therefore, it is necessary to control the amount of toner to be supplied to adjust the toner concentration in the developer within an appropriate range.

The toner concentration is controlled by comparing an output value Vt from a toner concentration detector (a permeability sensor) and a reference value Vref of a toner concentration, and setting the toner supply amount based on the comparison result.

A general method of detecting toner concentration uses a permeability sensor, in which permeability variation of the developer due to changes of the toner concentration is compared with a reference concentration to detect current toner concentration. Another toner concentration detecting method uses an optical sensor, in which a reference pattern is formed on an image carrier or on an intermediate transfer belt, reflection densities of an image portion and a non-image portion on the pattern are detected by the optical sensor, and toner concentration is detected based on the detection result. Besides, a method is also known in which a reference pattern is formed between sheets of paper to sequentially control a reference value Vref of a permeability sensor during printing. However, it is required to reduce, as much as possible, excessive consumption of toner caused by formation of a pattern between sheets, and there is a tendency not to perform correction based on the reference pattern formed between the sheets. When a pattern is formed on the intermediate transfer belt, a cleaning unit has to be arranged above a secondary transfer roller. Thus, in view of mechanical cost reduction, formation of a pattern between the sheets should be suppressed as much as possible. Accordingly, it is necessary to perform further accurate toner concentration control during continuous printing or at an image mode change (change of a process linear velocity) time using the permeability sensor alone.

In the two-component developing system, particularly, in a color image forming apparatus, an external additive such as silica or titanium oxide is applied to the toner surface to improve toner dispersibility. However, since the additive is susceptible to mechanical stress or thermal stress, they can be buried in toner, or separated from the surface during stirring in the developing system. As a result, fluidity or charging characteristic of the developer (including toner and carrier) and bulk density change. Further, the fluidity and the bulk density change due to decrease in chargeability (CA) of carrier caused by change in shape of the carrier surface, separation or accumulation of the external additive from and to toner, or carrier coat film wear with time.

These changes become a bottleneck for precisely detecting toner concentration by the permeability sensor. For example, in a system where a rotation speed of a stirring screw in the developing system changes according to image output modes based on a plurality of linear velocities, linear velocity shift takes place in which an output value changes even with the same toner concentration. One known approach to this problem is to previously obtain a linear velocity shift amount $\Delta Vt$ from experiment data to be used as a correction amount in toner supply control. However, when the correction amount changes depending on a degradation state or a usage state of the developer, it is difficult to perform accurate corrections.

Japanese Patent Application Laid-Open No. 2002-207357 discloses a technique in which toner concentration in a developing device is detected by a toner concentration detector (a permeability sensor), and the detection value is compared with a threshold value to control the toner concentration. The threshold value for the detection value obtained by the toner concentration detector is changed according to change in linear velocity of a photosensitive drum. According to the technique, however, although it is considered to be possible to perform control at the initial stage, correction for degradation over time is not taken into consideration. Therefore, it is difficult to maintain stability over a long period of time.

Japanese Patent Application Laid-Open No. 2002-14588 discloses a technique for changing a threshold value of a toner concentration sensor according to a rotation speed of a developing device (a conveying screw). However, in this technique, correction for degradation over time is not taken into consideration as in the technique described above. Thus, it is also difficult to maintain stability over a long period of time.

Japanese Patent Application Laid-Open No. 2003-280355 discloses a technique of using a toner concentration sensor (a permeability sensor) value Vt for toner concentration control. However, in the case of this technique, Vcnt (T sensor control voltage) is changed for arranging Vt values. Characteristics (sensitivity) of a sensor may change largely by change in the Vcnt, Vcnt cannot be easily changed. Additionally, it is necessary to adjust the Vcnt to achieve a target Vt value while a voltage is changed over about ten points with, for example, a dual-partitioning approach, and considerable time is required for the adjustment. Further, a toner concentration needs to be set to a reference value (8%) during the adjustment, which increases the time required for process control.

SUMMARY OF THE INVENTION

It is an object of the present invention to at least partially solve the problems in the conventional technology.

According to another aspect of the present invention, an image forming apparatus includes a developer container that holds a two-component developer containing a toner and a carrier, a toner concentration detector that detects toner concentration in the developer in a developing unit, a toner supplying unit configured to supply new toner to the developing unit, a process-linear-velocity setting unit that sets a process linear velocity from among a reference velocity, a first linear velocity lower than the reference velocity, and a second linear velocity lower than the first linear velocity, and a toner supply controlling unit. The toner supply controlling unit controls, when Vt0 is a toner concentration detected by the toner concentration detector for the reference linear velocity, Vt1 is a toner concentration detected by the toner concentration detector for the first linear velocity, and Vt2 is a toner concentration detected by the toner concentration detector for the second linear velocity, the toner supplying unit to supply the new toner to the developing unit to compensate for deficit $$\Delta Vt1 = Vt1 - Vt0$$

$$\Delta Vt2 = Vt2 - Vt0$$

in toner concentration in the developer in the developing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings. A printer adopting an electrophotographic system (hereinafter, "printer") is explained as one example of an image forming apparatus according to an embodiment of the present invention. A fundamental configuration of the printer is explained first.

Figure 1:
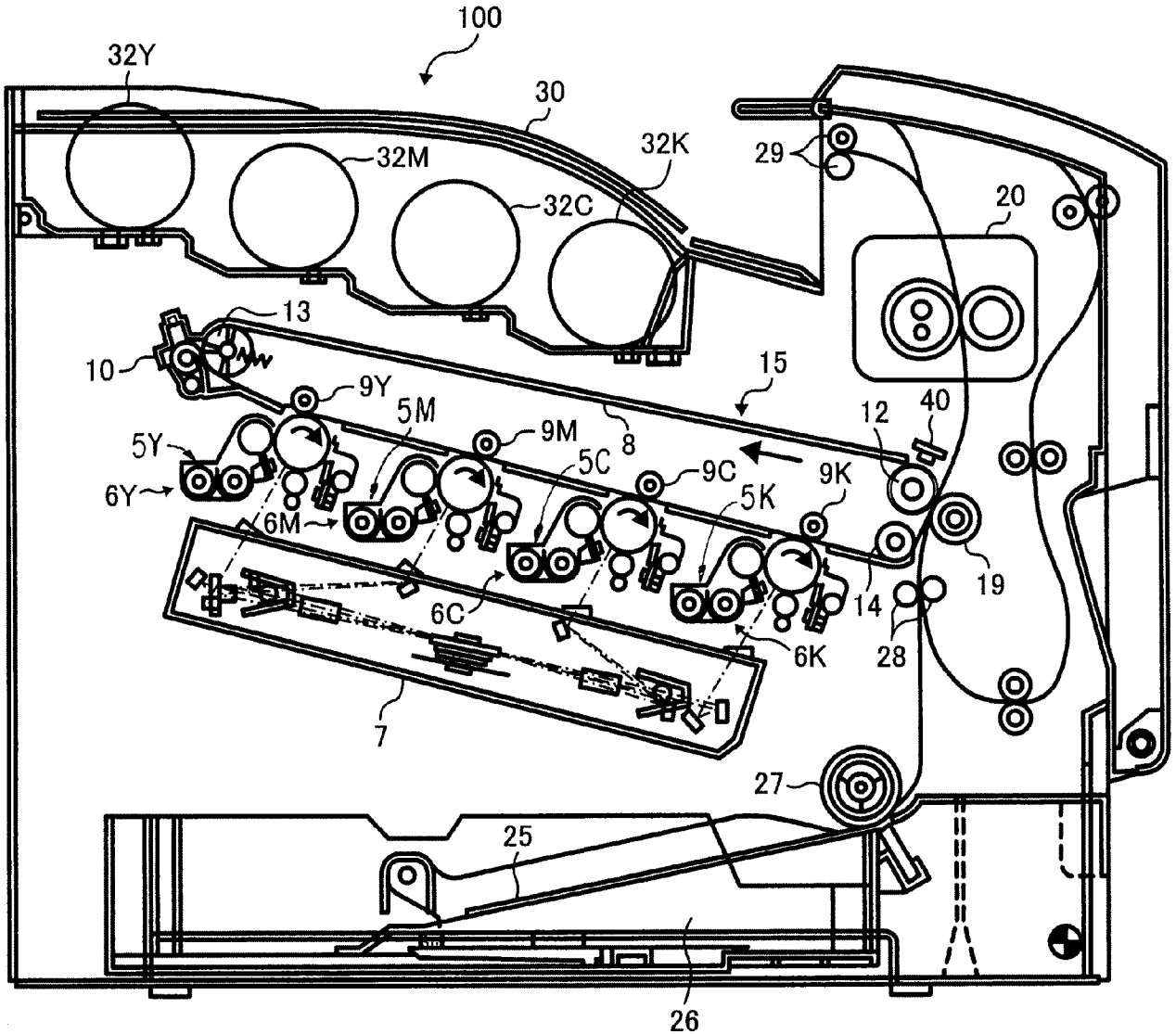
FIG. 1 is a schematic of an image forming apparatus according to an embodiment of the present invention.
Figure 2:
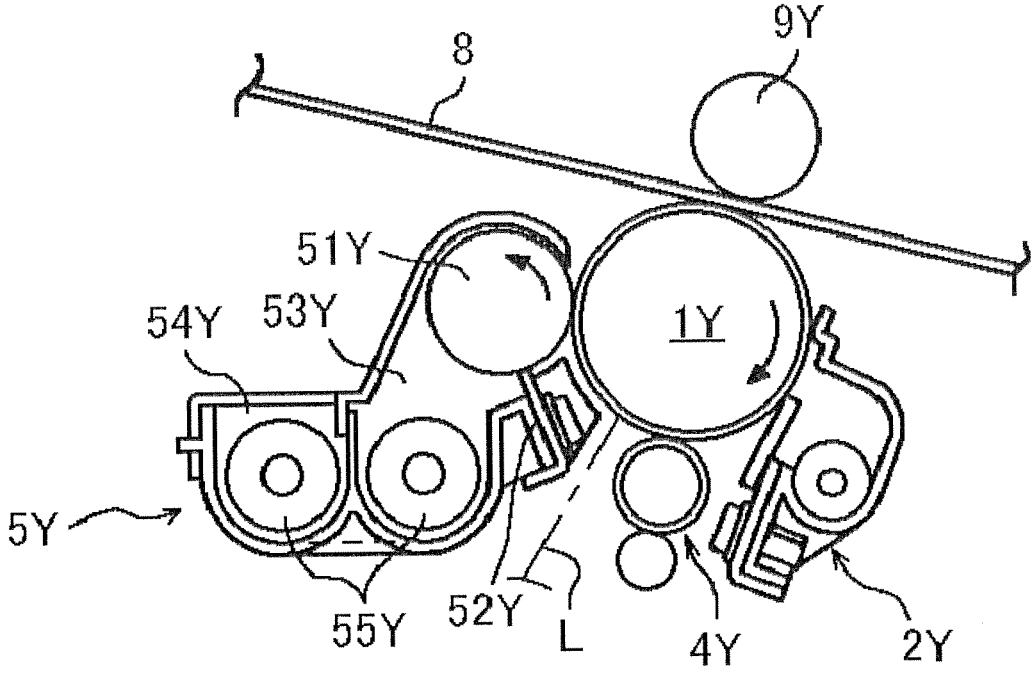
FIG. 2 is an enlarged view of a part of the image forming apparatus shown in FIG. 1.

FIG. 1 is a schematic of a printer 100. The printer 100 as an image forming apparatus includes four process cartridges 6Y, 6M, 6C, and 6K for generating toner images of yellow, magenta, cyan, and black (hereinafter, Y, M, C, and K). The process cartridges use 32Y, 32M, 32C, and 32K toner cartridges different in color from one another as image forming materials. The process cartridges 6Y, 6M, 6C, and 6K have the same configuration except for the color of toners to be used and are replaced at the end of their lives. In an example of the process cartridge 6Y for generating a Y toner image, as shown in FIG. 2, the process cartridge 6Y includes a photosensitive drum 1Y, a drum cleaning unit 2Y, a current remover (not shown), a charger 4Y, a developing unit 5Y, and the like. The process cartridge 6Y is attachable to and detachable from a main unit of the printer 100, so that plural expendable parts can be collectively replaced.

The charger 4Y evenly charges a surface of the photosensitive drum 1Y rotated in a clockwise direction in FIG. 2 by a driving unit (not shown). The surface of the photosensitive drum 1Y charged evenly is exposure-scanned by laser light L to carry thereon an electrostatic latent image for Y. The Y electrostatic latent image is developed to a Y toner image by the developing unit 5Y using Y toner, and the developed Y image is transferred on an intermediate transfer belt 8 by a primary transfer bias roller 9Y described later. The drum cleaning unit 2Y removes residual toner remaining on the surface of the photosensitive drum 1Y after an intermediate transfer process. The current remover removes residual charges on the photosensitive drum 1Y after being cleaned. By this current removal, the surface of the photosensitive drum 1Y is initialized for next image formation. Regarding the other process cartridges 6M, 6C, and 6K, M, C, and K toner images are similarly formed on photosensitive drums 1M, 1C, and 1K, and are transferred on the intermediate transfer belt 8.

As shown in FIG. 1, an exposing unit 7 is disposed below the process cartridges 6Y, 6M, 6C, and 6K. The exposing unit 7 serving as a latent image forming unit irradiates laser lights L emitted based on image information to respective photosensitive drums 1Y, 1M, 1C, and 1K in the process cartridges 6Y, 6M, 6C, and 6K to expose them. Electrostatic latent images for Y, M, C, and K are formed on the photosensitive drums 1Y, 1M, 1C, and 1K by the exposure. The exposing unit 7 irradiates laser lights (L) emitted from a light source to the photosensitive drums 1Y, 1M, 1C, and 1K via a plurality of optical lenses and mirrors while scanning the laser lights utilizing a polygon mirror rotationally driven by a motor.

A paper feed unit including a paper cassette 26, a paper feed roller 27 and a registration roller pair 28 incorporated in the printer 100, and the like is disposed below the exposing unit 7 in FIG. 1. The paper cassette 26 stores sheets of stacked transfer paper 25 which are recording mediums, in which the paper feed roller 27 abuts on the uppermost transfer paper 25. When the paper feed roller 27 is rotated in a counterclockwise direction in FIG. 1 by a driving unit (not shown), the uppermost transfer paper 25 is fed toward between rollers of the registration roller pair 28. Regarding the registration roller pair 28, both rollers thereof are rotationally driven for pinching the transfer paper 25, however, rotations thereof are once stopped lust after pinching. The registration roller pair 28 feeds the transfer paper 25 toward a secondary transfer nip described later at an appropriate timing. In the paper feed unit thus configured, a combination of the paper feed roller 27 and the registration roller pair 28 serving as a timing roller pair constitute a conveying unit. The conveying unit conveys the transfer paper 25 from the paper cassette 26 serving as a storage unit to the secondary transfer nip described later.

An intermediate transfer unit 15 that endlessly moves the intermediate transfer belt 8, which is an intermediate transfer member, in a spanned state is disposed above the process cartridges 6Y, 6M, 6C, and 6K in FIG. 1. The intermediate transfer unit 15 includes four primary transfer bias rollers 9Y, 9M, 9C, and 9K, a belt cleaning unit 10, and the like as well as the intermediate transfer belt 8. The intermediate transfer unit 15 also includes a secondary transfer backup roller 12, a cleaning backup roller 13, a tension roller 14, and the like. The intermediate transfer belt 8 is spanned about these three rollers 12, 13, and 14 and it is endlessly moved in a counterclockwise direction in FIG. 1 according to rotation of at least one of the rollers 12, 13, and 14. The primary transfer bias rollers 9Y, 9M, 9C, and 9K pinch the intermediate transfer belt 8 between the same and the photosensitive drums 1Y, 1M, 1C, and 1K to form primary transfer nips. The primary transfer bias rollers 9Y, 9M, 9C, and 9K adopt a system of applying a transfer bias having a polarity (for example, plus polarity) opposite from that of toners on a back face (a loop inner circumferential face) of the intermediate transfer belt 8. All the rollers 12, 13, and 14 other than the primary transfer bias rollers 9Y, 9M, 9C, and 9K are electrically grounded. While the intermediate transfer belt 8 sequentially passes through the primary transfer nips for Y, M, C, and K according to endless movement thereof, it is primarily transferred with Y, M, C, and K toner images on the photosensitive drums 1Y, 1M, 1C, and 1K in a superimposed manner. Thus, a toner image with four superimposed colors (hereinafter, "a four-color toner image") is formed on the intermediate transfer belt 8.

The secondary transfer backup roller 12 pinches the intermediate transfer belt 8 between the same and a secondary transfer roller 19 to form a secondary transfer nip. The four-color toner image formed on the intermediate transfer belt 8 is transferred on the transfer paper 25 at the secondary transfer nip. The intermediate transfer belt 8 after passing through the secondary transfer nip is adhered with post-transfer residual toner that has not been transferred on the transfer paper 25. The residual toner is cleaned by the belt cleaning unit 10.

In the secondary transfer nip, while the transfer paper 25 is pinched between the intermediate transfer belt 8 and the secondary transfer roller 19 whose surfaces are moved in forward directions, it is conveyed in an opposite direction from the registration roller pair 28. The transfer paper 25 fed from the secondary transfer nip is fixed with the four-color toner image transferred on the surface thereof by heat and pressure during passage between rollers in a fixing unit 20. Thereafter, the transfer paper 25 is discharged outside of the apparatus via rollers of a discharge roller pair 29. A stack portion 30 is formed on an upper face of the printer main unit, and the sheets of transfer paper 25 discharged outside of the apparatus by the discharge roller pair 29 are sequentially stacked on the stack portion 30.

In FIG. 1, a reflection type photosensor 40 serving as an image density detector is disposed above the secondary transfer backup roller 12, and the reflection type photosensor 40 outputs a signal corresponding to a light reflectivity on the intermediate transfer belt 8. As the reflection type photosensor 40, one of a diffused light detecting type and a regularly reflected light detecting type, which can set a difference between an amount of reflected light from the surface of the intermediate transfer belt 8 and an amount of reflected light from a reference pattern image described later to a sufficiently large value, is used. The function of the reflection type photosensor 40 is described later.

A configuration of calibration for the printer 100 is explained next.

Figure 3:
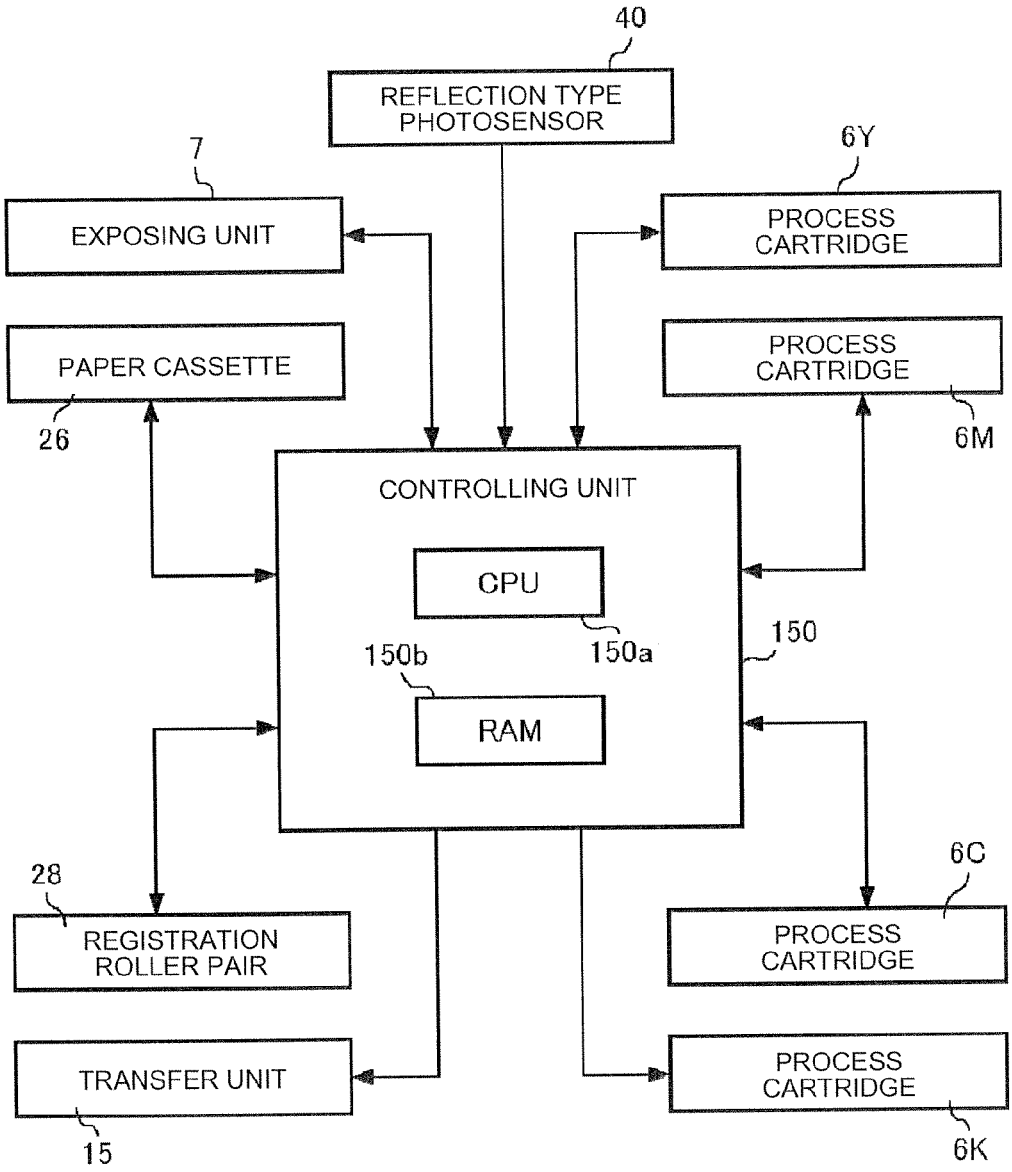
FIG. 3 is a block diagram of part of an electric circuit in the image forming apparatus.

FIG. 3 is a block diagram of part of an electric circuit in the printer 100. In FIG. 3, a controlling unit 150 controls process cartridges 6Y, 6M, 6C, and 6K, the exposing unit 7, the paper cassette 26, the registration roller pair 28, the transfer unit (intermediate transfer unit) 15, the reflection type photosensor 40, and the like electrically connected thereto. The controlling unit 150 includes a central processing unit (CPU) 150*a* that controls an operation unit and the like, and a random access memory (RAM) 150*b* that stores data.

The controlling unit 150 tests imaging performance such as image forming performances of the respective process cartridges 6Y, 6M, 6C, 6K at a predetermined timing, such as at a power-ON time of a main power supply (not shown), at a standby time after a predetermined time elapses, or at a standby time after a predetermined number of printed paper are output.

Specifically, the photosensitive drums 1Y, 1M, 1C, and 1K are charged evenly while being rotated when the predetermined timing arrives. The charging is different from the even charging (for example, −700 Volts) performed during ordinary printing in that a potential is gradually increased. While electrostatic latent images for reference pattern images are formed according to scanning of the laser lights, they are developed by developing unit 5Y and developing units corresponding to M, C, and K. Bias development pattern images of respective colors are formed on the photosensitive drums 1Y, 1M, 1C, and 1K according to the development. At the time of the development, the controlling unit 150 controls to gradually increase values of developing biases applied to developing rollers in the developing unit 5Y and developing units corresponding to M, C, and K.

The bias development pattern images of the respective colors are transferred onto the intermediate transfer belt 8 so as to be arranged in parallel without overlapping with one another. By the transfer, pattern blocks formed of reference pattern images with respective colors are formed on the intermediate transfer belt 8.

When reference images of the respective reference pattern images of the pattern blocks pass through a position facing the reflection type photosensor 40 along with an endless movement of the intermediate transfer belt 8, amounts of light reflections from the reference images are detected to be output to the controlling unit 150 as electric signals. The controlling unit 150 calculates light reflectivities of respective reference images based on output signals sequentially sent from the reflection type photosensor 40 to store them in the RAM 150*b* as concentration pattern data.

The pattern blocks which have passed through a position facing the refection type photosensor 40 are cleaned by the belt cleaning unit 10.

Figure 4:
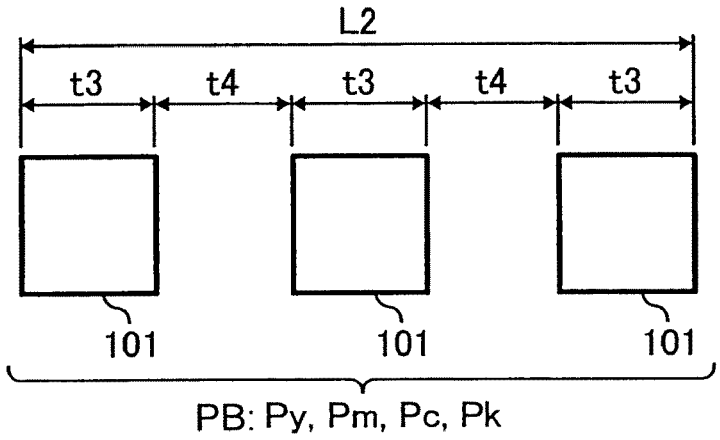
FIG. 4 is a schematic of a reference pattern image.

FIG. 4 is a schematic of a pattern block PB including reference pattern images Py, Pm, Pc, and Pk. The reference pattern images Py, Pm, Pc, and Pk include three reference images arranged at intervals of 15 millimeters. In the laser printer 100 of the embodiment, the respective reference images 101 have a size of a vertical length of 15 millimeters×a horizontal length t3 of 15 millimeters, and they are formed at a distance t4 of 15 millimeters. Therefore, lengths L2 of the reference pattern images Py, Pm, Pc, and Pk on the intermediate transfer belt 8 is 75 millimeters, respectively. The reference pattern images Py, Pm, Pc, and Pk are transferred on the intermediate transfer belt 8 without overlapping with one another, which is different from toner images with respective colors formed during print processing. One pattern block PB including the reference pattern images Py, Pm, Pc, and Pk for respective colors is formed on the intermediate transfer belt 8 by the transfer.

Figure 5:
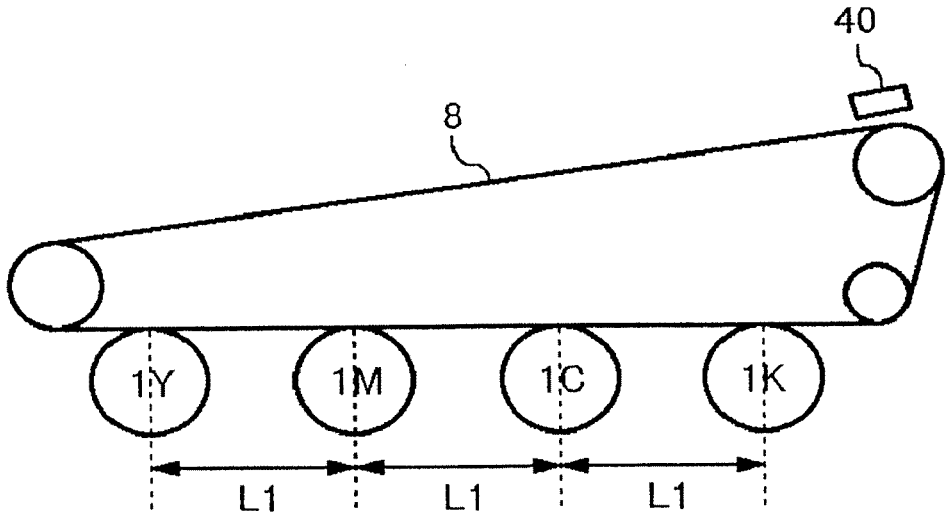
FIG. 5 is a schematic for explaining an arrangement pitch of photosensitive drums in the image forming apparatus.

FIG. 5 is a schematic for explaining an arrangement pitch of the photosensitive drums 1Y, 1M, 1C, and 1K. As shown in FIG. 5, the photosensitive drums 1Y, 1M, 1C, and 1K are arranged at intervals of L1=90 millimeters. As described above, the lengths L2 of the reference pattern images Py, Pm, Pc, and Pk are respectively 75 millimeters, which is shorter than the arrangement pitch (interval) L1 of the photosensitive drums 1Y, 1M, 1C, and 1K. Therefore, it is possible to transfer the reference pattern images Py, Pm, Pc, and Pk independently such that their ends do not overlap with one another.

Figure 6:
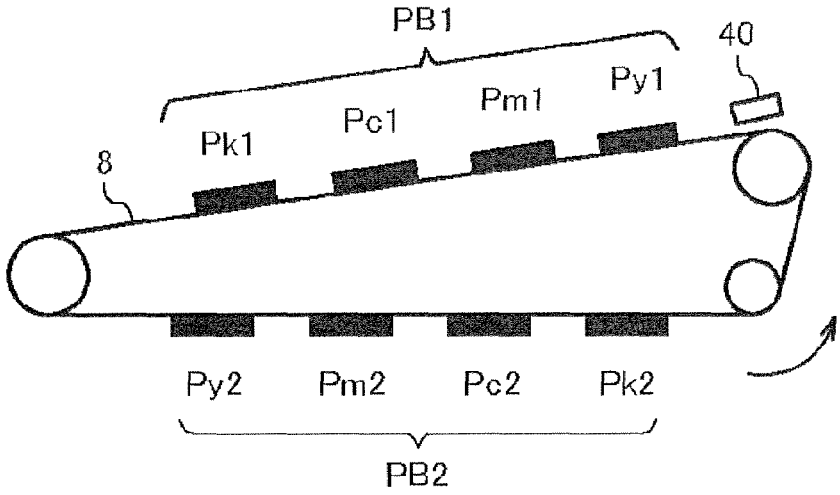
FIG. 6 is a schematic of pattern blocks formed on an intermediate transfer belt shown in FIG. 1.

FIG. 6 is a schematic of pattern blocks PB1 and PB2 formed on the intermediate transfer belt 8. Two pattern blocks PB each including four reference patterns Pk, Pc, Pm, and Py are formed on the intermediate transfer belt 8. Specifically, pattern block PB1 including reference pattern images Pk1, Pc1, Pm1, and Py1, and pattern block PB2 including reference pattern images Pk2, Pc2, Pm2, and Py2 are formed.

The pattern blocks PB1 and PB2 are formed as follows. That is, the controlling unit 150 moves the reference pattern images Pk1, Pc1, Pm1, and Py1 on the intermediate transfer belt 8 from a time point at which transfer of the reference pattern images Pk1, Pc1, Pm1, and Py1 in the first pattern block PB1 onto the intermediate transfer belt 8 has been completed to completion of passage of the most upstream reference pattern Py1 through a transfer nip in the most downstream photosensitive drum 1K.

The controlling unit 150 causes the photosensitive drums 1Y, 1M, 1C, and 1K to form the respective reference pattern images Pk2, Pc2, Pm2, and Py2 of the second pattern block PB2 at a predetermined timing. Specifically, the predetermined timing is a timing at which transfer of the reference pattern images Pk2, Pc2, Pm2, and Py2 of the pattern block PB2 onto the intermediate transfer belt 8 starts from a time point at which movement has been further performed by a predetermined amount after passage of the rear end (the reference pattern image Py1) of the first pattern block PB1 through the transfer nip of the most downstream photosensitive drum 1K.

In FIG. 6, the reflection type photosensor 40 serving as an image detector is disposed at an upper right portion of the transfer unit 15 including the intermediate transfer belt 8. The respective reference pattern images Pk, Pc, Pm, Py on the intermediate transfer belt 8 are moved along with an endless movement of the intermediate transfer belt 8, and after they are detected by the reflection type photosensor 40, they are removed by the belt cleaning unit 10 in the transfer unit 15.

The reflection type photosensor 40 detects amounts of reflection lights from the respective reference images 101 constituting the reference pattern images Pk1, Pc1, Pm1, and Pyl from the leading end of the first pattern block PB1 to the tailing end thereof in the following order. That is, detection is made in the order of three reference images 101 of the reference pattern images Pk1, three reference images 101 of the reference pattern images Pc1, three reference images 101 of the reference pattern images Pm1, and three reference images 101 of the reference pattern images Py1. At this time, voltage signals corresponding to amounts of reflection lights from the respective reference images 101 are detected utilizing a method described later and they are sequentially output to the controlling unit 150. The controlling unit 150 sequentially calculates image densities of the respective reference images 101 based on the voltage signals sequentially sent from the reflection type photosensor 40 and stores them in the RAM 150*b*. It is desirable that a diffusion light detection type is used for the reflection type photosensor 40 because it can sense a high concentration portion of color toner.

Figure 7:
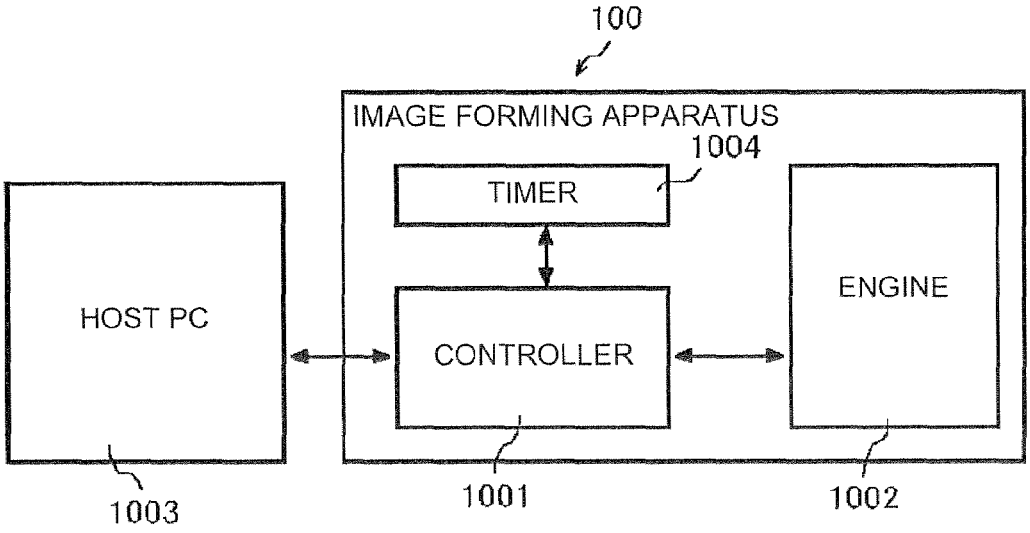
FIG. 7 is a schematic of an image forming system according to an embodiment of the present invention.

A controller 1001 of the printer 100 is explained next. FIG. 7 is a schematic of an image forming system of the embodiment. The image forming system includes a host personal computer (PC) 1003 and an image forming apparatus 100 (printer 100) that outputs an image on a recording medium based on image information from the host PC 1003. The host PC 1003 and an image forming apparatus 100 are connected through an interface that enables bidirectional communication.

When a data file prepared by the host PC 1003 receives a print instruction, it is developed to a language for the image forming apparatus 100 by a device driver in the controller 1001 and it is transferred to the image forming apparatus 100 via the interface as image information.

The controller 1001 generates cluster data for each page based on the image information transferred from the host PC 1003 to supply the cluster data to an engine 1002. The engine 1002 forms a latent image on a photosensitive drum based on the image information supplied from the controller 1001 and transfers and fixes (electrophotographic system) the latent image on a recording medium, thereby forming an image. The controller 1001 grasps information on status change (environment change such as temperature or humidity, or internal status change such as a toner remaining amount) of the engine 1002 and issues a calibration run command to the engine 1002 to make the engine execute calibration.

Figure 8:
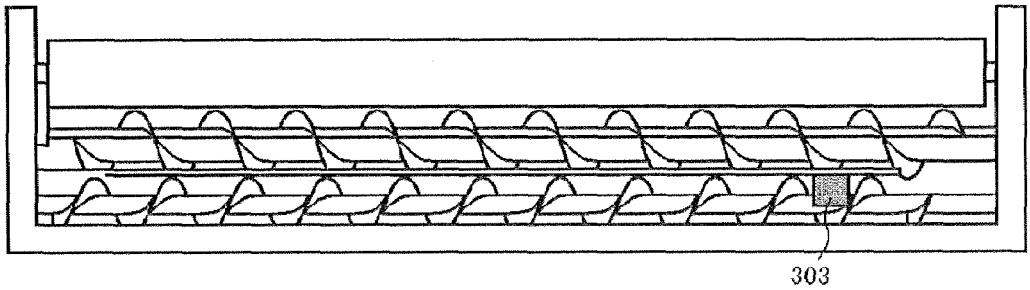
FIG. 8 is a schematic configuration of a developing unit shown in FIG. 2.

The developing unit 5Y in the process cartridge 6Y of the printer 100 is explained next with reference to FIGS. 2 and 8. The developing unit 5Y includes a magnetic field generator therein, and also includes a developing sleeve 51Y that carries a two-component developer containing magnetic particles and toner particles on a surface thereof to convey the developer and serves as a developer carrier, and a doctor blade 52Y that restricts a layer thickness of the developer carried on the developing sleeve 51Y to be conveyed and serves as a developer restricting member.

A developer receiving section 53Y that receives developer that is restricted by the doctor blade 52Y so as not to be conveyed to a developing region facing the photosensitive drum 1Y is formed upstream of the doctor blade 52Y in a conveying direction of the developer. A toner receiving section 54Y that receives toner and a toner conveying screw 55Y for stirring and conveying toner are provided adjacent to the developer receiving section 53Y. The toner conveying screw 55Y has a structure in which a blade is fixed to a rotational shaft.

An operation of the developing unit 5Y is explained next.

In the developing unit 5Y, a developer layer is formed on the developing sleeve 51Y. Carrier and toner are contained in the developer, and toner is taken in such that the developer maintains a predetermined toner concentration range.

Regarding the toner, toner accommodated in a toner cartridge 32Y is supplied to the toner receiving section 54Y by a toner conveying unit (not shown). Thereafter, the toner is stirred by the toner conveying screw 55Y to be taken into the developer, and it is charged according to frictional charging with carrier. The developer containing charged toner is supplied onto a surface of the developing sleeve 51Y including a magnetic pole therein, and it is carried on the developing sleeve 51Y owing to magnetic force. A developer layer carried on the developing sleeve 51Y is conveyed in a direction of arrow according to rotation of the developing sleeve 51Y. After thickness of the developer layer is restricted by the doctor blade 52Y, it is conveyed to the developing region facing the photosensitive drum 1Y. In the developing region, development is performed based on the latent image formed on the photosensitive drum 1Y. The developer layer remaining on the developing sleeve 51Y is conveyed upstream of the developer receiving section 53Y in the conveying direction of the developer according to rotation of the developing sleeve 51Y.

A linear velocity shift amount calculating method in the embodiment is explained next.

Figure 9:
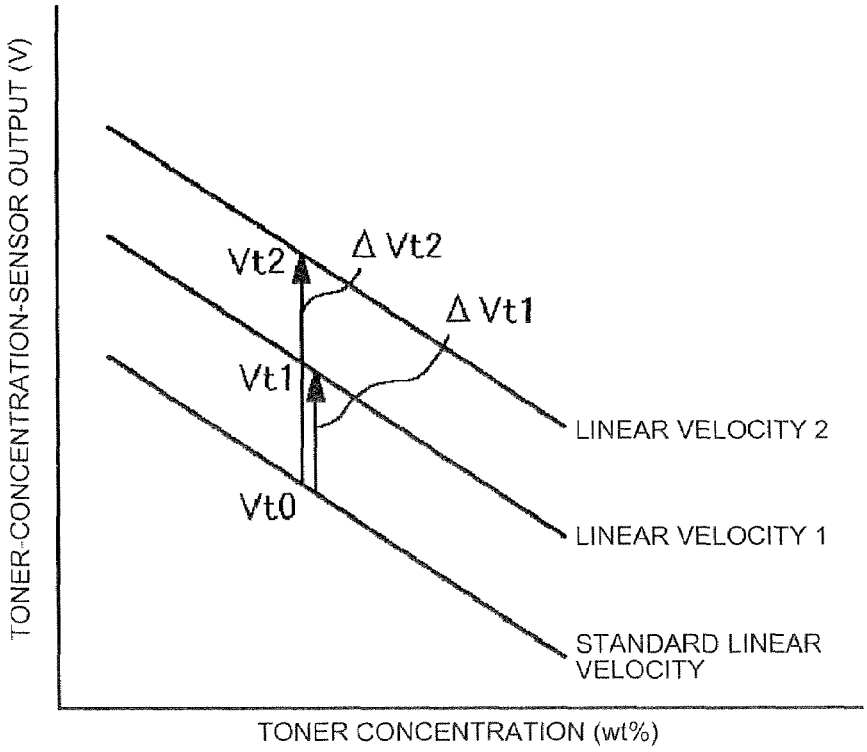
FIG. 9 is a graph of the relationship between an output from a toner concentration sensor shown in FIG. 8 and a toner concentration with respect to linear velocity.

Toner supply control performed for each printing is explained first. A toner concentration sensor 303 serving as a toner concentration detector can perform linear approximation in a certain range of toner concentration, as shown in FIG. 9, in which a vertical axis indicates an output of the toner concentration sensor 303 and a horizontal axis indicates a toner concentration. As can be understood with reference to FIG. 9, the graph shows a characteristic in which an output value becomes smaller according to increase in toner concentration. By utilizing the characteristic, when an output value Vt from the toner concentration sensor 303 is larger than a control reference value Vtref, a supply unit is driven to supply toner.

A developer characteristic value measuring method and a correcting method according to the embodiment is specifically explained below. The printer 100 includes an image output mode including change of a plurality of process linear velocities including an ordinary velocity, a first low linear velocity, and a second low linear velocity. As shown in FIG. 9, in an image forming apparatus including a plurality of process linear velocities, an output of the toner concentration sensor is output as a different value even in the same toner concentration. Consequently, the output value Vt deviates from the control reference value Vtref largely so that an appropriate toner supply control becomes difficult. Therefore, it is necessary to calculate a linear velocity shift amount accurately according to the developer status to reflect the linear velocity shift amount as a toner supply parameter to perform correction on a toner-concentration-sensor output Vt for each linear velocity.

A method for calculating the linear velocity shift amount accurately according to a developer status to reflect the result as a toner supply parameter is explained below.

Figure 10:
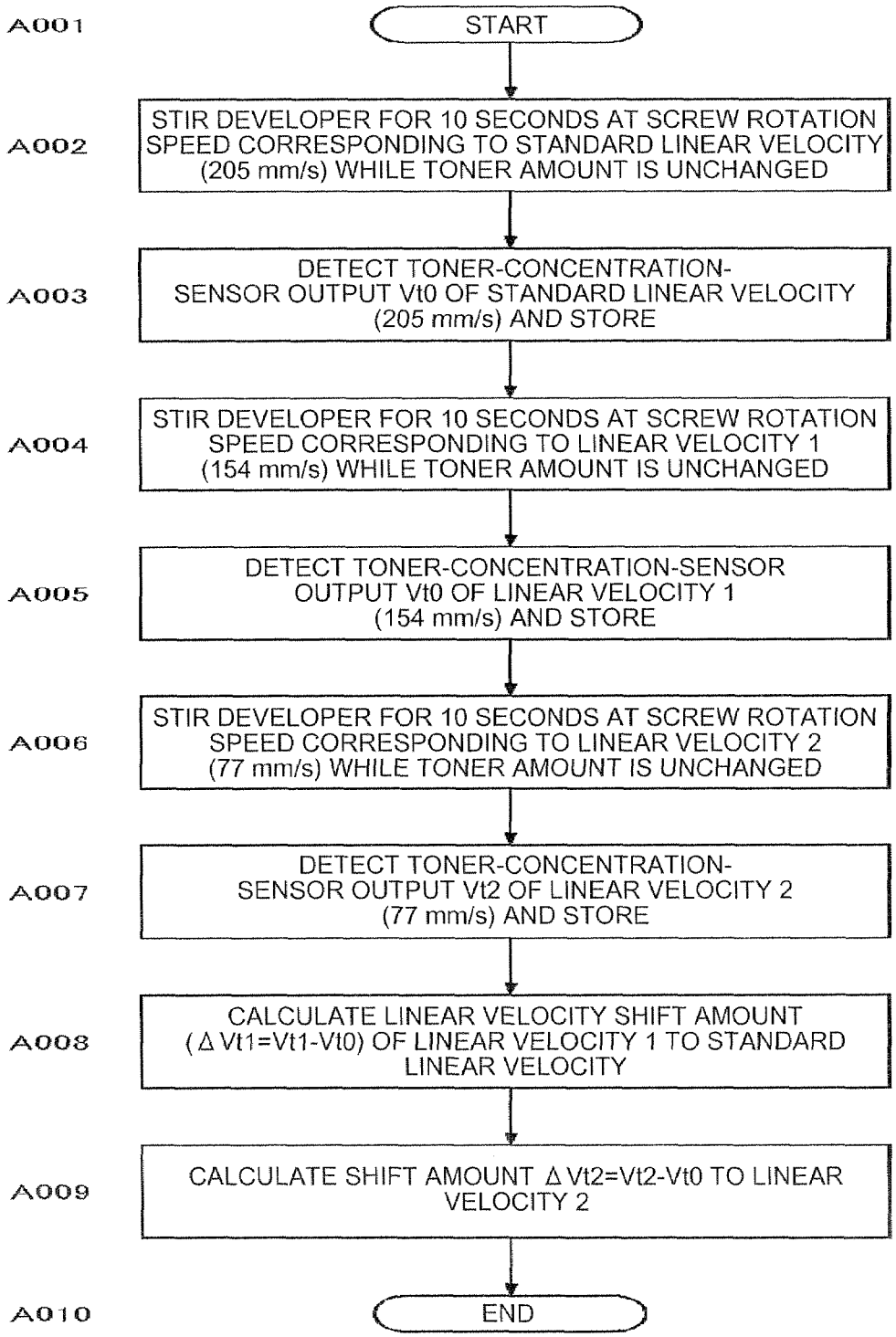
FIG. 10 is a flowchart of calculation of a linear velocity shift amount.

A basic procedure of a linear velocity shift amount calculation in the embodiment is explained along with a flow shown in FIG. 10 (A001 to A010).

In FIG. 10, developer is stirred for 10 seconds at a screw rotation speed corresponding to a standard linear velocity while toner amount is unchanged (A002), and a toner-concentration-sensor output Vt0 at the standard linear velocity is detected in a state that a developer state has been sufficiently stabilized (A003). Regarding a linear velocity 1 and a linear velocity 2, developer is stirred for 10 seconds at a screw rotation speed corresponding to each linear velocity, and toner-concentration-sensor outputs Vt1 and Vt2 at times of the first low linear velocity and the second low linear velocity are detected (A004 to A007). Toner-concentration-sensor outputs at respective linear velocities in the developer detected in a state that toner amount is unchanged and the toner is stirred to be stabilized, become accurate.

Linear velocity shift amounts:

$$\Delta Vt1-Vt1-Vt0;\text{ and}$$

$$\Delta Vt2-Vt2-Vt0$$

are calculated from a difference between toner-concentration-sensor outputs (A008 and A009) to be reflected to toner supply control as correction amounts for respective linear velocities.

Regarding the correction, fixed values which are obtained experimentally are conventionally used as the correction amounts for the respective linear velocities. However, since fluidity and bulk density of the developer change according to advance of developer deterioration, an output of the toner concentration sensor fluctuates largely, which results in difficulty of accurate Vt correction after some time elapses. Since correction taking into account the change of developer characteristic due to environment change can not be performed by using the fixed values, behavior in a high temperature and high humidity state or in a low temperature and low humidity state becomes unstable. When the fixed values are used, since it is impossible to perform correction regarding variations in the toner concentration sensor itself, variations in toner concentration sensor mounting, a difference among developer lots, or the like, a method for determining correction amounts taking into account all fluctuation factors is demanded. In the embodiment, it is possible to measure change of developer characteristic according to environment change and developer degradation to calculate a correction amount of the toner-concentration-sensor output Vt accurately and perform updating, thereby achieving higher stability.

A method for calculating a linear velocity shift amount at an initial agent setting time is explained next with reference to a flow shown in FIG. 11.

Figure 11:
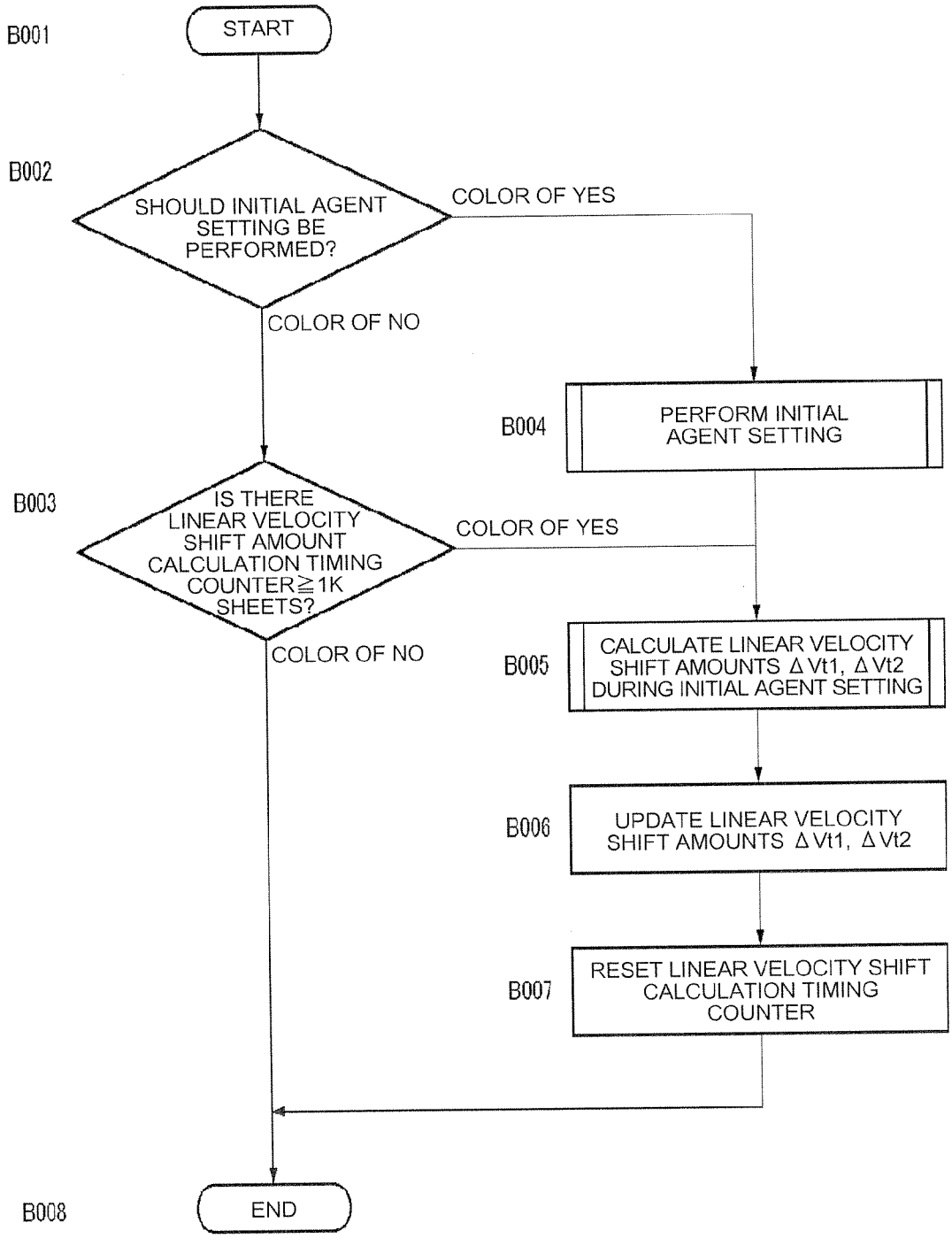
FIG. 11 is a flowchart of calculation of a linear velocity shift amount at an initial agent setting time.

When a new developing unit is set, since it is necessary to consider the variations in the toner concentration sensor itself, variations in the toner concentration sensor mounting, variations in the developing unit, the difference among developer lots, and the like, a linear velocity shift amount is calculated at an initial agent setting time in a flow (B001 and B004 to B008 through color of Yes at B002), as shown in FIG. 11. The initial agent setting is an operation for adjusting a control voltage Vcnt of the toner concentration sensor when a new developing unit is set.

Figure 12:
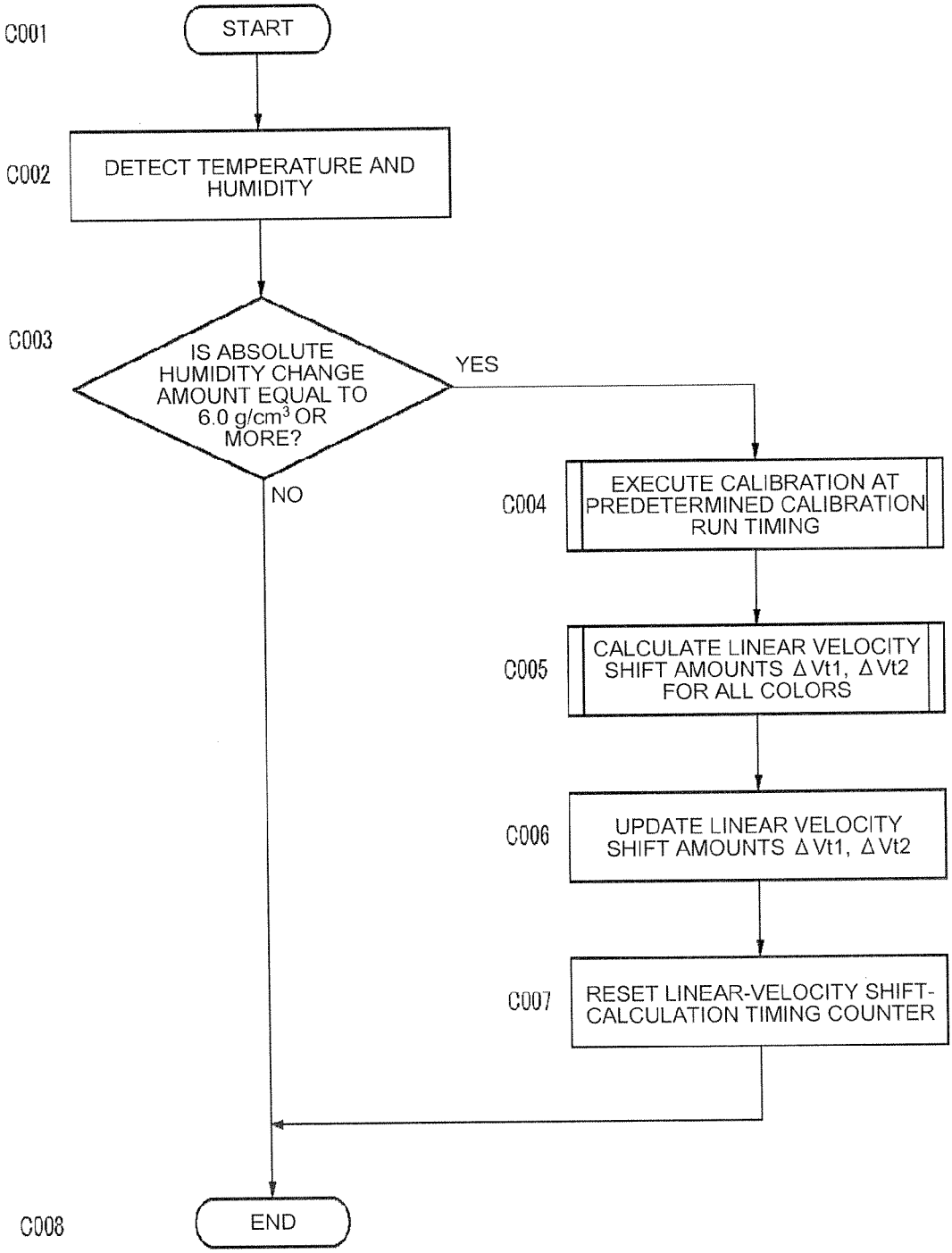
FIG. 12 is a flowchart of calculation of a linear velocity shift amount based on temperature, humidity, and elapsed time.

A method for calculating a linear velocity shift amount based on information output from a temperature and humidity sensor and an elapsed-time counter is explained next with reference to a flow shown in FIG. 12.

When environment changes largely, the linear velocity shift amount is calculated based on information from the temperature and humidity sensor. In the flow shown in FIG. 12, whether a linear velocity shift amount is calculated is determined based on an absolute humidity change amount threshold value (C001 to C008). When an absolute humidity change amount is equal to 6.0 g/cm$^3$ or more (Yes at C003), linear velocity shift amounts for all the colors are calculated based on a calibration run timing of the apparatus (C004 to C007). The calculation for linear velocity shift amounts can be performed at a print job end time to reduce a user waiting time described later.

When the developer is left unused for a long time, it becomes a factor for largely changing the developer characteristic, other than the environment factors. This can be solved by performing processing similar to that in the flow of FIG. 12 based on information from the elapsed-time counter utilizing a timer 1004 shown in FIG. 7.

Next, a method for calculating linear velocity shift amounts based on information from a counter for counting the number of sheets is explained next with reference to a flow shown in FIG. 13 (D001 to D009).

The linear velocity shift amount is calculated based on information from the counter for counting the number of sheets for degradation of the developer over time. For example, when the linear velocity shift amount corresponding to degradation over time should be calculated for each 3K sheets, 3K-th sheet in counting the number of sheets from calculation of the previous linear velocity shift amount is set as a linear velocity shift amount calculation timing.

Regarding developer of a color which has reached the linear velocity shift amount calculation timing, a linear velocity shift amount is calculated just after calibration of the apparatus (from D004 to D006 to D008). The calculation of linear velocity shift amounts can be performed at a print job end time to reduce a user waiting time described later.

According to the methods described above, the linear velocity shift amount can be calculated accurately regardless of an initial state of the developer, environmental change, change due to being left unused, or degradation over time.

Figure 15:
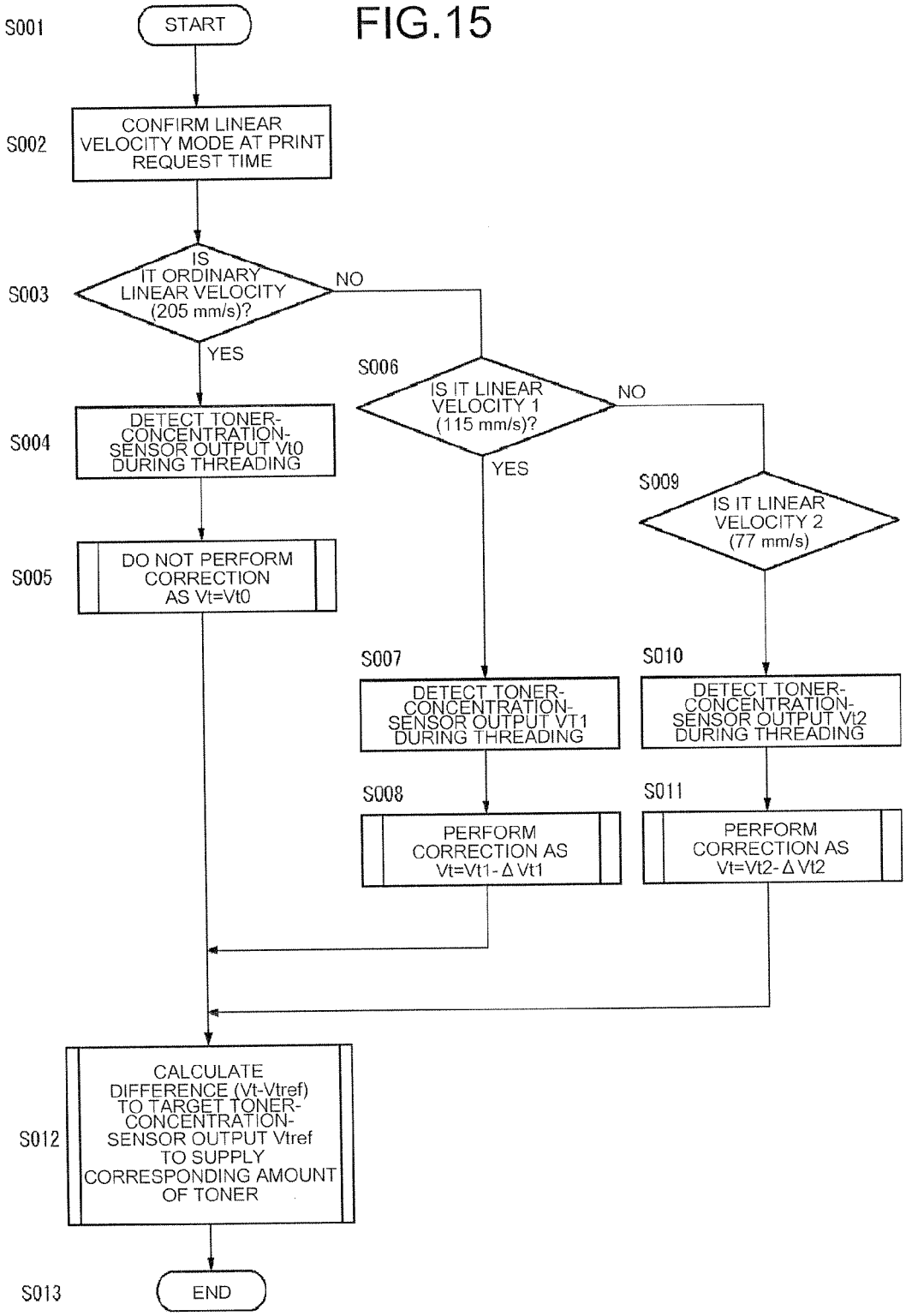
FIG. 15 is a flowchart of another example of calculation of a linear velocity shift amount.

A flowchart for reflecting the linear velocity shift amount as a correction amount in supply control is explained next with reference to a flow shown in FIG. 15 (S001 to S013).

At step S002, a print mode is first detected. Next, a process linear velocity is determined at step S003. When the process linear velocity is a standard linear velocity (Yes at S003), a toner-concentration-sensor output Vt0 at the standard linear velocity is detected at S004. If the process linear velocity is the standard linear velocity, it is unnecessary to perform correction, so that the detected output is utilized as Vt=Vt0 as it is at S005.

When the process linear velocity is a linear velocity other than the standard linear velocity (No at S003), determination about the linear velocity is made and the control proceeds to S006 or S009. When the process linear velocity is the linear velocity 1 (S006), a toner-concentration-sensor output Vt1 is first detected at S007. Since Vt1 is higher than the standard linear velocity by a linear velocity shift amount ΔVt1, correction and update are conducted as the toner-concentration-sensor output Vt=(Vt1−ΔVt1) at S008. Regarding the linear velocity 2 (S009), a toner-concentration-sensor output Vt2 is similarly detected at S010, and correction and update are conducted at S011 as Vt=(Vt2−ΔVt2) considering the linear velocity shift amount ΔVt2.

A difference (Vt−Vtref) is calculated from the toner-concentration-sensor output Vt thus corrected and the target toner-concentration-sensor output Vtref so as to conduct control for supplying a corresponding amount of toner (S012).

In the embodiment, regarding the process linear velocities in respective modes, the process linear velocity in the standard mode is 205 mm/s, the process linear velocity in the linear velocity 1 is 115 mm/s, and the process linear velocity in the linear velocity 2 is 77 mm/s.

How to calculate the linear velocity shift amount without generating a user's waiting time is explained next.

When an initial agent setting is performed after replacing only a developer unit for one color, a linear velocity shift amount corresponding to an initial developer state is calculated for the developer unit (B004, and B005 to B007). However, if the linear velocity shift amount regarding a color whose initial agent setting is not performed is simultaneously calculated, the future waiting time of the user can be reduced. When developer idle stirring is conducted continuously, developer degradation may occur, so that whether the calculation should be performed is determined according to a linear velocity shift amount calculation timing counter threshold value (from B003 to B005 to B007).

The linear velocity shift amount is calculated for the color which has reached the linear velocity shift amount calculation timing (from D004 to D006 to 008). However, if the linear velocity shift amounts for the other colors are calculated on the momentum of the timing, the future waiting time of the user can be reduced. However, when developer idle stirring is conducted continuously, developer degradation may occur, so that whether the calculation should be performed is determined according to a linear velocity shift amount calculation timing counter threshold value (D005 and D006 to 008).

Figure 13:
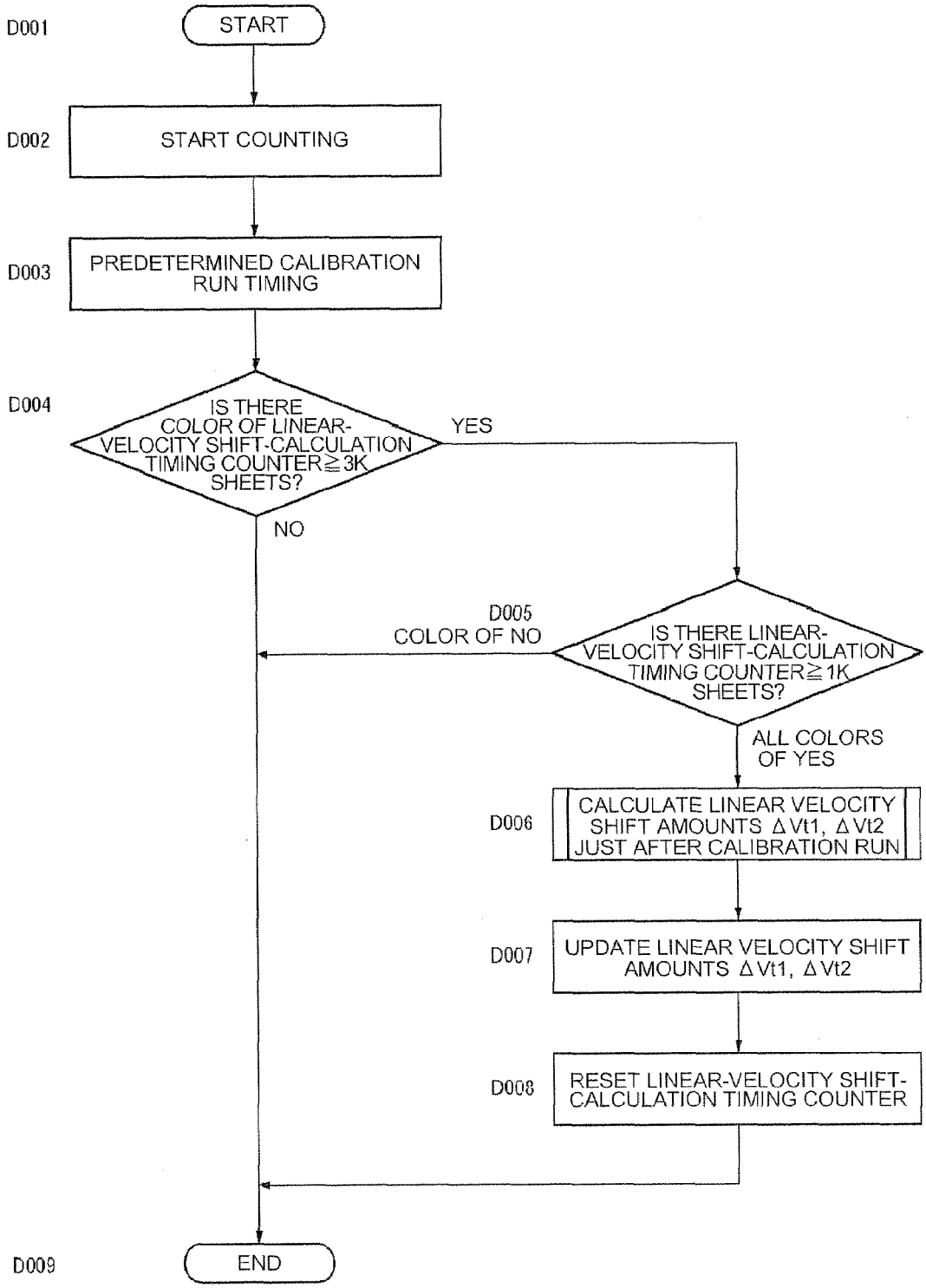
FIG. 13 is a flowchart of calculation of a linear velocity shift mount based on the number of sheets.

While the linear velocity shift amount is calculated just after calibration run in the flow of FIG. 13, the linear velocity shift amount can be calculated after the print job ends so as to make a user aware of a waiting time.

Figure 14:
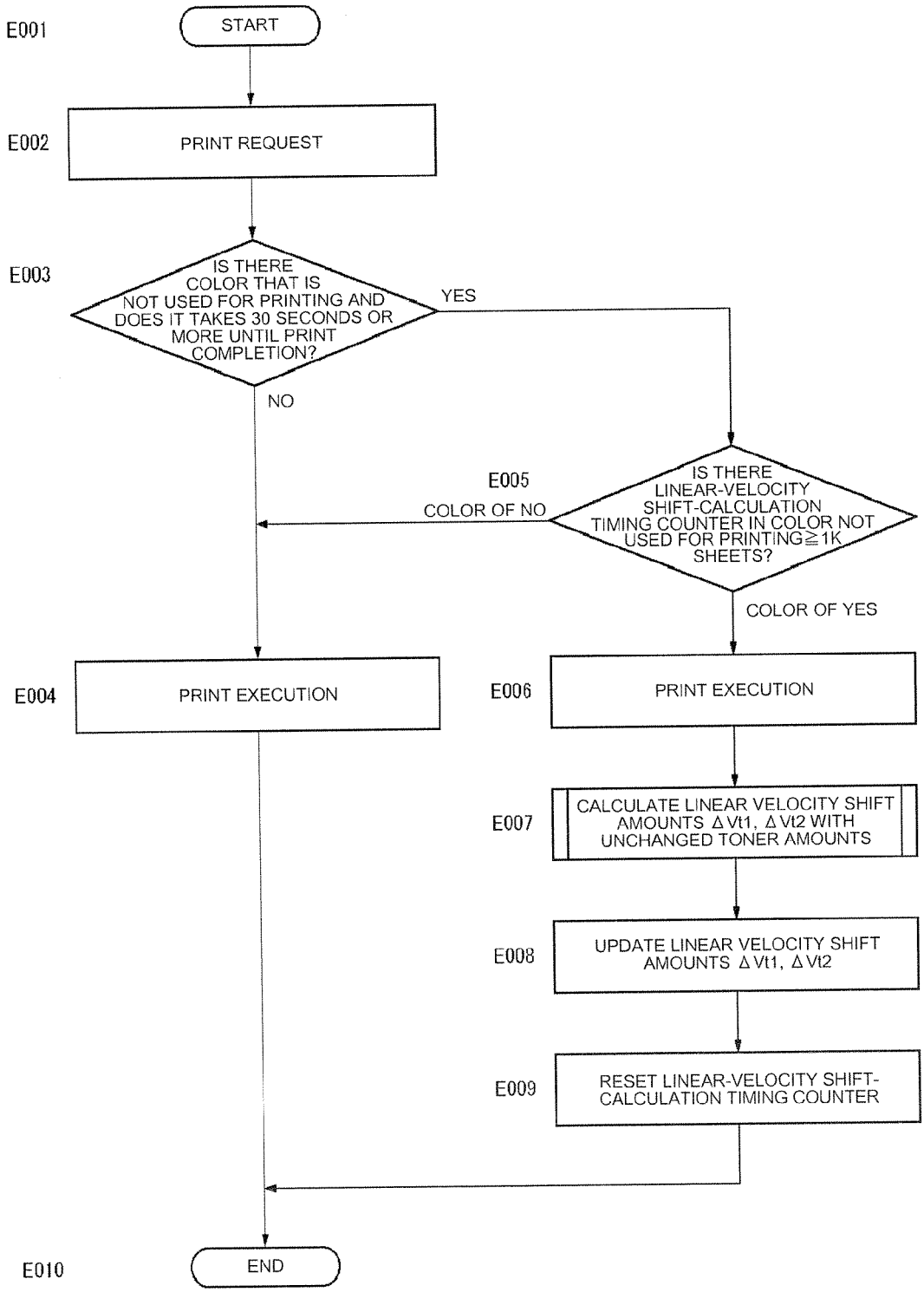
FIG. 14 is a flowchart of an example of calculation of a linear velocity shift amount.

There can often be a color that is not used for printing depending on a print request from the user. In this case, during the printing, by stabilizing the developer that is not used for printing without changing the toner amount, the linear velocity shift amount can be calculated without generating any user's waiting time. A procedure therefor is explained below with reference to a flow shown in FIG. 14 (E001 to E010).

A print request is received from the user (E002). If a print content is that there is a color that is not used for printing and a quite some time is required for calculating a linear velocity shift amount (Yes at E003), a linear velocity shift amount of the color that is not used for printing is calculated during printing (E006 to E009).

However, when developer idle stirring is conducted continuously, developer degradation can occur, so that whether the calculation should be performed is determined according to a linear velocity shift amount calculation timing counter threshold value (E005).

According to an embodiment of the present invention, a linear velocity shift amount can be calculated accurately based on the state of a developer, and a more accurate correction amount can be reflected in toner supply control.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a developer container that holds a two-component developer containing a toner and a carrier;

a toner concentration detector that detects toner concentration in the developer in a developing unit;

a toner supplying unit configured to supply new toner to the developing unit;

a process-linear-velocity setting unit that sets a process linear velocity from among a reference velocity, a first linear velocity lower than the reference velocity, and a second linear velocity lower than the first linear velocity; and a toner supply controlling unit, wherein Vt0 is a toner concentration detected by the toner concentration detector for the reference linear velocity, Vt1 is a toner concentration detected by the toner concentration detector for the first linear velocity, Vt2 is a toner concentration detected by the toner concentration detector for the second linear velocity, and the toner supply controlling unit controls the toner supplying unit to supply the new toner to the developing unit to compensate for a deficit $$\Delta Vt1 = Vt1 - Vt0$$

$$\Delta Vt2 = Vt2 - Vt0$$

in toner concentration in the developer in the developing unit.

2. The image forming apparatus according to claim 1, further comprising an initial agent setting unit that performs initial agent setting to adjust a control voltage Vcnt for the toner concentration detector when a new developer is set, wherein a parameter calculating unit calculates linear velocity shift amounts ΔVt1 and ΔVt2 during the initial agent setting.

3. The image forming apparatus according to claim 1, further comprising:

an initial agent setting unit that performs initial agent setting to adjust a control voltage Vcnt for the toner concentration detector when a new developer is set, wherein a parameter calculating unit calculates linear velocity shift amounts ΔVt1 and ΔVt2 after the initial agent setting.

4. The image forming apparatus according to claim 1, comprising:

a plurality of developing units configured to form a color image; and an initial agent setting unit that performs initial agent setting to adjust a control voltage Vcnt for the toner concentration detector when a new developer is set, wherein when the initial agent setting unit performs the initial agent setting for a first color, a parameter calculating unit calculates linear velocity shift amounts ΔVt1 and ΔVt2 for the first color, and a second color for which the initial agent setting unit does not perform the initial agent setting, depending on a time at which the second color requires the initial agent setting.

5. The image forming apparatus according to claim 4, further comprising:

a controller that calculates a time taken from print start to print completion, wherein when a print instruction indicates a color that is not to be used for a printing, and the controller determines that calculation of the linear velocity shift amounts ΔVt1 and ΔVt2 for the color is to be completed during the printing, the parameter calculating unit calculates the linear velocity shift amounts ΔVt1 and ΔVt2 for the color during the printing.

6. The image forming apparatus according to claim 1, further comprising:

a parameter changing unit that changes an image forming parameter based on a calibration run of the image forming apparatus, wherein a parameter calculating unit calculates linear velocity shift amounts ΔVt1 and ΔVt2 at a time of a calibration run that satisfies a certain condition.

7. The image forming apparatus according to claim 6, further comprising:

a counter that counts number of passed sheets of paper;

a temperature and humidity detecting sensor; and an elapsed-time counter, wherein the certain condition is determined based on information from at least one of the counter, the temperature and humidity detecting sensor, or the elapsed-time counter.

8. The image forming apparatus according to claim 7, wherein when an absolute humidity change amount is 6.0 $g/cm^3$ or more, linear velocity shift amounts for all colors are calculated based on a calibration run timing of the apparatus.

9. The image forming apparatus according to claim 1, further comprising:

a counter that counts a number of passing sheets, wherein the counter counts number of passing sheets from a previous linear velocity shift amount calculation, and a time at which linear velocity shift amounts ΔVt1 and ΔVt2 are calculated is determined according to the number of the passing sheets.

* * * * *